US008853142B2

(12) United States Patent
Corominas et al.

(10) Patent No.: US 8,853,142 B2
(45) Date of Patent: Oct. 7, 2014

(54) METHODS FOR PRODUCING LIQUID DETERGENT PRODUCTS

(75) Inventors: Francesc Corominas, Grimbergen (BE); Laurens Beelen, Mechelen (BE); Mohamed Akalay, Grimbergen (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/405,694

(22) Filed: Feb. 27, 2012

(65) Prior Publication Data

US 2013/0225468 A1 Aug. 29, 2013

(51) Int. Cl.
*C11D 11/00* (2006.01)
*C11D 3/50* (2006.01)

(52) U.S. Cl.
USPC ..... 510/337; 510/338; 510/349; 510/407; 510/418

(58) Field of Classification Search
USPC ..... 510/337, 338, 349, 407, 418
See application file for complete search history.

(56) References Cited

U.S. PATENT DOCUMENTS

| | | | | |
|---|---|---|---|---|
| 7,994,111 | B2 * | 8/2011 | Caggioni et al. | 510/473 |
| 2005/0227907 | A1 * | 10/2005 | Lee et al. | 512/4 |
| 2009/0209445 | A1 * | 8/2009 | Panandiker et al. | 510/296 |

FOREIGN PATENT DOCUMENTS

| | | | | |
|---|---|---|---|---|
| EP | 2 258 820 | A1 | | 12/2010 |
| WO | WO 2010/034736 | A1 | * | 4/2010 |
| WO | WO 2010/144397 | A1 | * | 12/2010 |
| WO | WO 2011/120772 | A1 | * | 10/2011 |
| WO | WO 2011/120772 | A1 | | 10/2011 |

OTHER PUBLICATIONS

U.S. Appl. No. 13/406,254, filed Feb. 27, 2012, Khalaf, et al.
U.S. Appl. No. 13/406,127, filed Feb. 27, 2012, Meskens, et al.
PCT Search report: PCT/IB2013/053214; Dated Jan. 17, 2014.

* cited by examiner

*Primary Examiner* — Lorna M Douyon
(74) *Attorney, Agent, or Firm* — Gregory S. Darley-Emerson; Steven W. Miller

(57) ABSTRACT

Disclosed herein are methods for producing liquid detergent products using a vessel comprising an inlet, an outlet, an agitation device, and an additive mixing zone disposed between the inlet and the outlet. The method comprises introducing an unstructured liquid detergent precursor into the inlet of the vessel; mixing an additive and the unstructured liquid detergent precursor in an additive mixing zone to form a combined additive detergent; adding a structurant to the combined additive detergent downstream of the additive mixing zone to form a liquid detergent product. The liquid detergent products may be used in a water-soluble pouch, for e.g., a multi-compartment water-soluble pouch.

13 Claims, 4 Drawing Sheets

METHODS FOR PRODUCING LIQUID DETERGENT PRODUCTS

TECHNICAL FIELD

This disclosure relates generally to methods for producing liquid detergent products having improved product aesthetics and performance.

BACKGROUND

Laundry detergent composition aesthetics are important to consumers. For example, it has been found that consumers tend to associate an opaque, white detergent composition with cleanliness. Also, having a good scent associated with the detergent composition is important to consumers. However, these aesthetic additives are not always stable once added to a detergent composition. During processing, opacifiers, for example, when added to a base detergent composition comprising less than about 15% of water can form white particles. Perfume microcapsules added to the base detergent composition can agglomerate or self-associate thereby limiting performance in delivering fragrance to fabrics. In addition, soil suspending polymers or structurants when added to the detergent base can form gel particles and gel balls (from agglomeration of the gel particles). During processing, the white and gel particles, as well as perfume microcapsule agglomerates can accumulate in the system and clog pipes. In addition, these white particles can be visible in the finished product.

Accordingly, there is a need to develop a process for producing a liquid detergent composition comprising an opacifier without the formation of white particles. There is also a need to develop a process for producing a liquid detergent composition comprising perfume microcapsules without the formation of large perfume microcapsule aggregates. There is further a need to develop a process for producing a liquid detergent composition comprising a soil suspending polymer and/or a structurant without the formation of gel particles or gel balls.

SUMMARY

Accordingly, disclosed are methods for producing liquid detergent products using a vessel comprising an inlet, an outlet, an agitation device, and a microcapsule mixing zone disposed between the inlet and the outlet. The method comprises: a) introducing an unstructured liquid detergent precursor into the inlet of the vessel, said unstructured liquid detergent precursor comprising from about 10% to 90%, by weight of the precursor, of a surfactant, and from about 0% to about 15%, by weight of the precursor, of water; b) mixing an aqueous slurry comprising perfume microcapsules and the unstructured liquid detergent precursor in the microcapsule mixing zone to form a combined microcapsule detergent; and c) adding a structurant to the combined microcapsule detergent downstream of the microcapsule mixing zone to form a liquid detergent product.

Additional embodiments are directed to methods for forming a liquid detergent product using a vessel comprising an inlet, an outlet, and an opacifier mixing zone disposed between the inlet and the outlet. The method comprises: a) introducing an unstructured liquid detergent precursor into the inlet of the vessel, said precursor comprising from about 10% to 90%, by weight of the precursor, of a surfactant, and from about 0% to about 15%, by weight of the precursor, of water; b) adding an opacifier to the unstructured liquid detergent precursor upstream of the opacifier mixing zone; c) mixing the opacifier and the unstructured liquid detergent precursor in the opacifier mixing zone to form an opaque detergent; and d) adding a structurant to the opaque detergent downstream of the opacifier mixing zone to zone to form the liquid detergent product.

DETAILED DESCRIPTION

Features and benefits of the various embodiments of the present invention will become apparent from the following description, which includes examples of specific embodiments intended to give a broad representation of the invention. Various modifications will be apparent to those skilled in the art from this description and from practice of the invention. The scope is not intended to be limited to the particular forms disclosed and the invention covers all modifications, equivalents and alternatives falling within the spirit and scope of the invention as defined by the claims.

Disclosed herein are methods for producing liquid detergent products. By the term 'liquid', it is meant to include liquid, paste, waxy or gel compositions. The liquid detergent products may be used in a water-soluble pouch, for e.g., a multi-compartment water-soluble pouch. The pouch may comprise a water-soluble film and at least a first, and optionally, a second compartment. In some examples, the first compartment comprises a liquid detergent product comprising perfume microcapsules. In other examples, the first compartment comprises a liquid detergent product comprising an opacifier. The optional second compartment comprises a second detergent product. The pouch may further comprise an optional third compartment comprising a third detergent product. The optionally second and third detergent products may be visibly distinct from each other and from the first detergent product.

Process

Examples described herein include methods for producing a liquid detergent product using a vessel comprising an inlet, an outlet, an agitation device, and an additive mixing zone disposed between the inlet and the outlet. As described in greater detail below, the method comprises introducing an unstructured liquid detergent precursor into the inlet of the vessel, said unstructured liquid detergent precursor comprising from about 10% to 90%, by weight of the precursor, of a surfactant, and from about 0% to about 15%, by weight of the precursor, of water; mixing an additive and the unstructured liquid detergent precursor in an additive mixing zone to form a combined additive detergent; adding a structurant to the combined additive detergent downstream of the additive mixing zone to form a liquid detergent product. In some examples, the additive may comprise perfume microcapsules, opacifiers and mixtures thereof.

Figure 1:
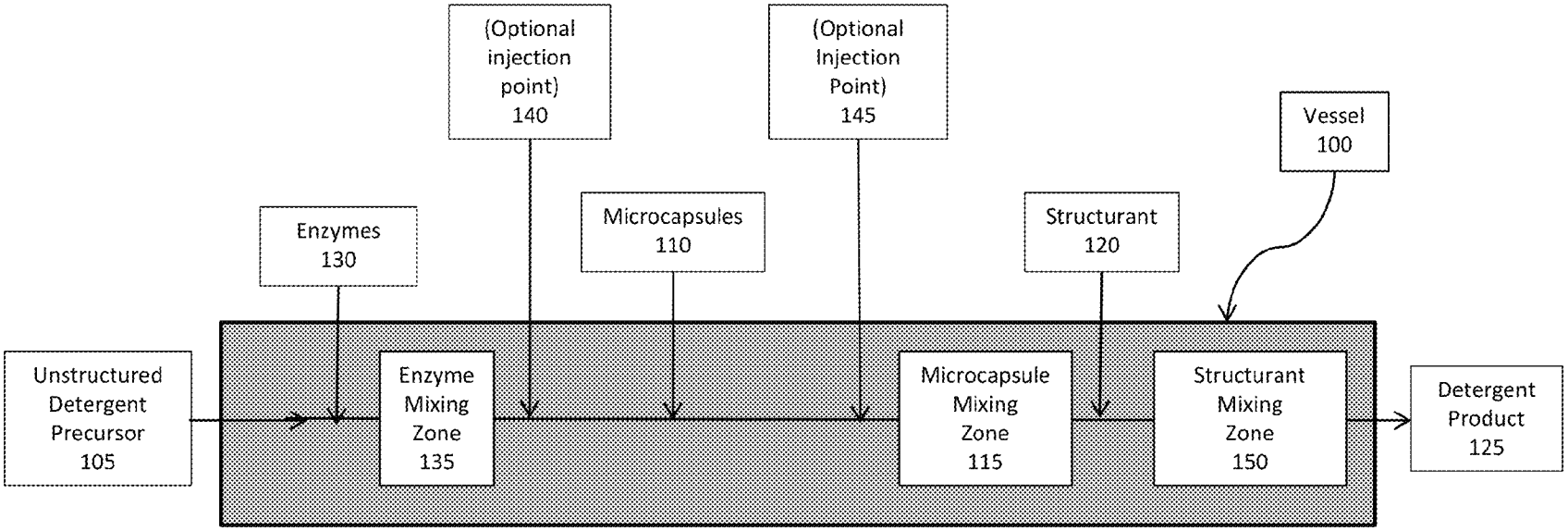
FIG. 1 depicts a flowchart of an exemplary production method of a liquid detergent product according to one or more embodiments shown and described herein.

Referring to FIG. 1, a method of producing a liquid detergent product is depicted. The method comprises introducing an unstructured liquid detergent precursor (105) into the inlet of a vessel (100), said unstructured liquid detergent precursor (105) comprising from about 10% to 90%, by weight of the precursor, of a surfactant, and from about 0% to about 15%, by weight of the precursor, of water; mixing an aqueous slurry comprising perfume microcapsules (110) and the unstructured liquid detergent precursor (105) in the microcapsule mixing zone (115) to form a combined microcapsule detergent; adding a structurant (120) to the combined microcapsule detergent downstream of the microcapsule mixing zone (115) to form a liquid detergent product (125).

Figure 2:
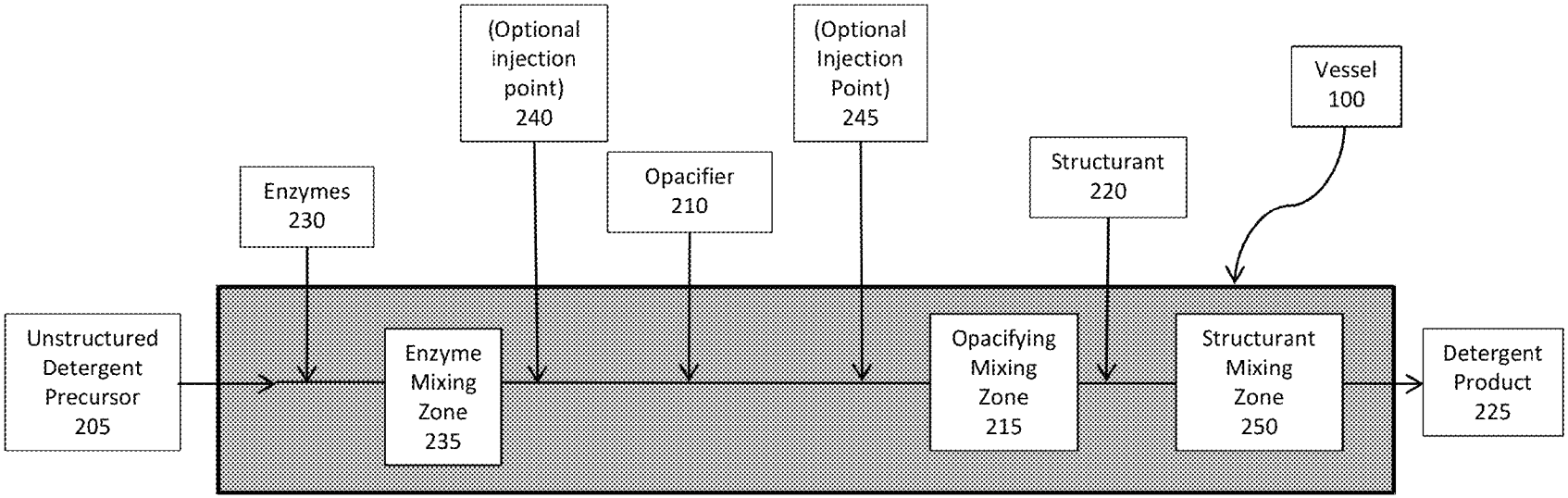
FIG. 2 depicts a flowchart of an exemplary production method of a liquid detergent product according to one or more embodiments shown and described herein.

Referring to FIG. 2, the method comprises introducing an unstructured liquid detergent precursor (205) into the inlet of a vessel (100), said precursor comprising from about 10% to 90%, by weight of the precursor, of a surfactant, and from about 0% to about 15%, by weight of the precursor, of water; adding an opacifier (210) to the unstructured liquid detergent precursor (205) upstream of the opacifier mixing zone (215); mixing the opacifier (210) and the unstructured liquid detergent precursor (205) in the opacifier mixing zone (215) to form an opaque detergent; adding a structurant (220) to the opaque detergent downstream of the opacifier mixing zone (215) to form a liquid detergent product (225).

Optional Process Steps

Referring to FIG. 1, the method may also comprise adding one or more enzymes (130) to the unstructured liquid detergent precursor (105) upstream of the microcapsule mixing zone (115) and prior to adding the aqueous microcapsule slurry (110) to the precursor (105). After enzyme addition, the one or more enzymes (130) and unstructured liquid detergent precursor (105) are mixed in an enzyme mixing zone (135), which is disposed upstream of the microcapsule mixing zone (115). Downstream of the enzyme mixing zone (135), one or more adjunct ingredients may be added. In some examples, the one or more adjunct ingredients are added prior to (140) the addition of the aqueous microcapsule slurry (110). In some examples, the one or more adjunct ingredients are added after (145) the addition of the aqueous microcapsule slurry (110), but prior to the microcapsule mixing zone (115). In further examples, one or more adjunct ingredients may be added both prior to (140) and after (145) the addition of the aqueous microcapsule slurry (110). While only two optional injection points 140, 145 are depicted in FIG. 1, those skilled in the art will appreciate that additional optional injection points may be used and/or the optional injection points 140, 145 may be located at other points in the process. The structurant (120) is added upstream of a structurant mixing zone (150). After the addition of the structurant (120), the process may comprise mixing the structurant (120) with the combined microcapsule detergent in the structurant mixing zone (150) to form the detergent product (125).

Similarly, referring to FIG. 2, the method may comprise adding one or more enzymes (230) to the unstructured liquid detergent precursor (205) upstream of the opacifier mixing zone (215) and prior to adding the opacifier (210) to the precursor (205). After enzyme addition, the one or more enzymes (230) and unstructured liquid detergent precursor (205) are mixed in an enzyme mixing zone (235), which is disposed upstream of the opacifier mixing zone (215). Downstream of the enzyme mixing zone (235), one or more adjunct ingredients may be added. In some examples, the one or more adjunct ingredients are added prior to (240) the addition of the opacifier (210). In some examples, the one or more adjunct ingredients are added after (245) the addition of the opacifier (210), but prior to the opacifier mixing zone (215). In further examples, one or more adjunct ingredients may be added both prior to (240) and after (245) the addition of the opacifier (210). While only two optional injection points 240, 245 are depicted in FIG. 2, those skilled in the art will appreciate that additional optional injection points may be used and/or the optional injection points 240, 245 may be located at other points in the process. The structurant (220) is added upstream of a structurant mixing zone (250). After the addition of the structurant (220), the process may comprise mixing the structurant (220) with the opaque detergent in the structurant mixing zone (250) to form the detergent product (225).

Vessel

The present liquid detergent products are made by simple mixing methods using a vessel comprising an inlet, an outlet, an agitation device, and a mixing zone disposed between the inlet and the outlet. In some examples, the agitation device comprises a mixer. Examples of mixers include, but are not limited to, static mixers and in-line mixers. The agitation device delivers an energy input of from about 50 J/kg to about 500 J/kg. In some examples, the agitation device delivers an energy input of from about 100 J/kg to about 400 J/kg. In further examples, the agitation device delivers an energy input of from about 50 J/kg to about 300 J/kg. Without being bound by theory, it is believed that Applicants' energy input range provides enough energy to properly disperse the ingredients.

Figure 3:
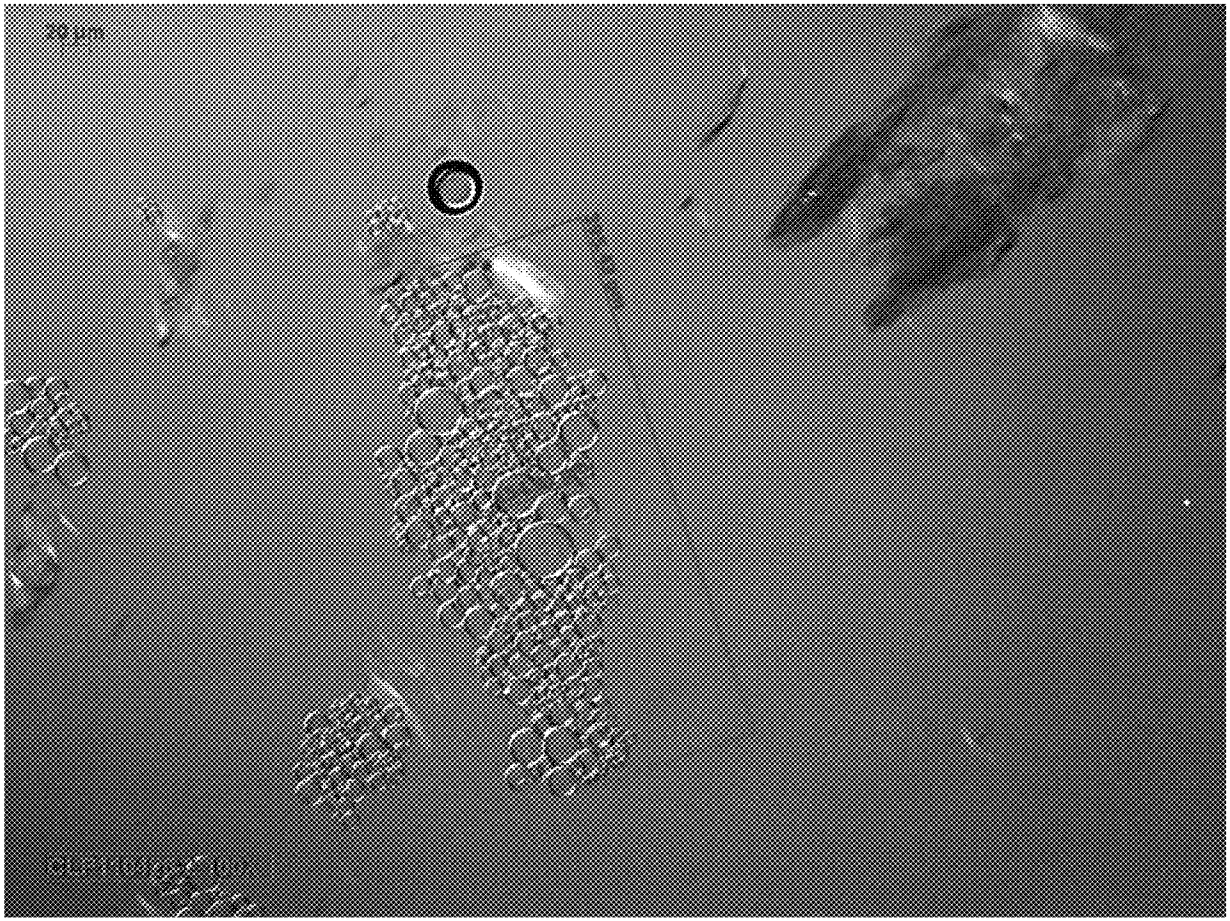
FIG. 3 depicts a micrograph of perfume microcapsules incorporated into a liquid detergent product under low mixing energy.
Figure 4:
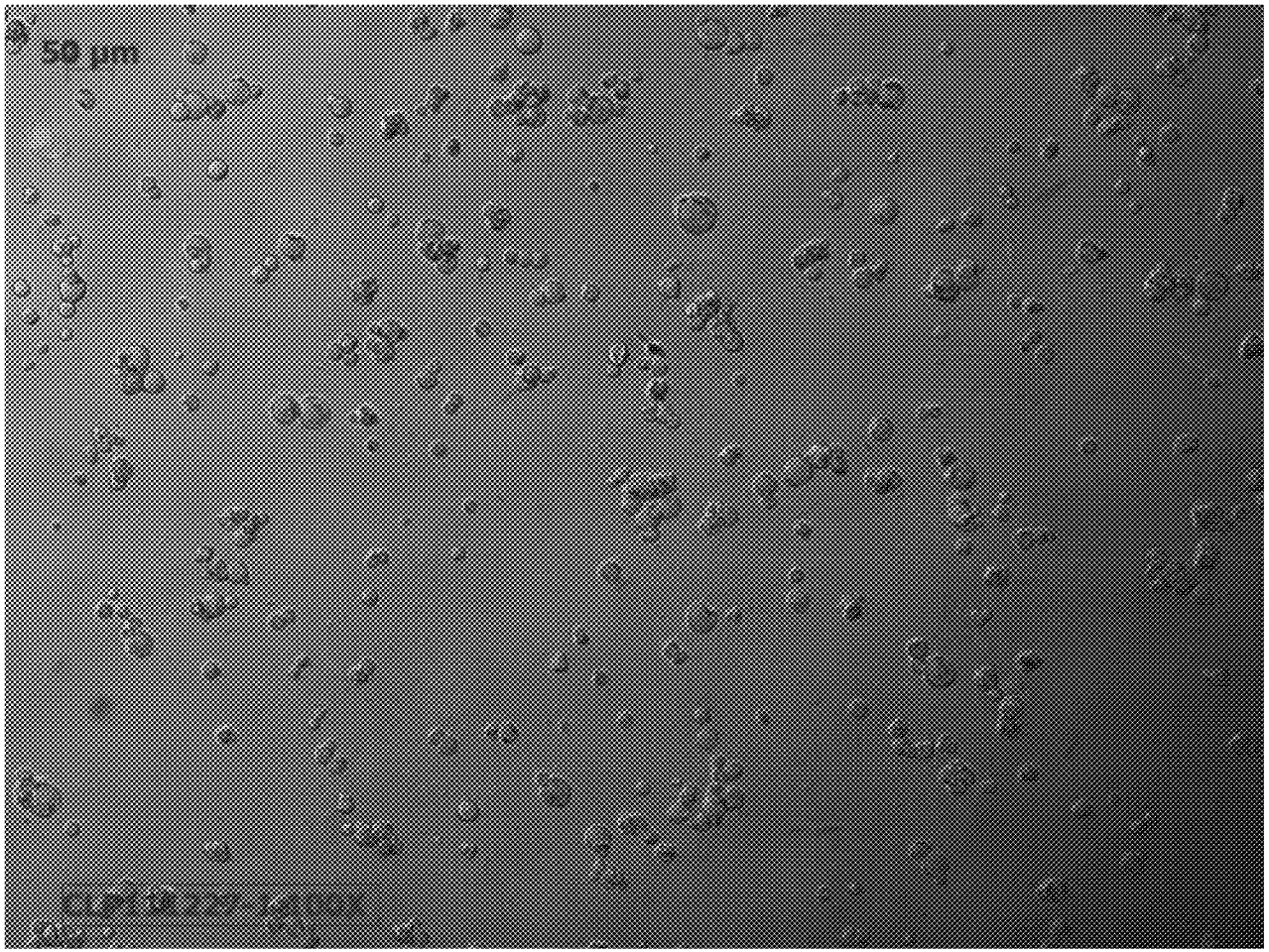
FIG. 4 depicts a micrograph of perfume microcapsules incorporated into a liquid detergent product under proper mixing energy.

As shown in FIG. 3, improper or no mixing energy input in the microcapsule mixing zone can lead to perfume microcapsule aggregation after addition of perfume microcapsules to the detergent precursor. Without intending to be bound by theory, it is believed that if the average microcapsule aggregate size greater than about 100 microns (for e.g., as shown in FIG. 3), the aggregates may become visible to the eye in the liquid detergent product; the liquid detergent product may become less stable resulting in separation, settling or creaming out over extended periods of time, the number of microcapsules entrained in the fabric may be reduced or unevenly distributed; and the aggregated microcapsules may clog pipes and mixers during processing. FIG. 4 depicts the perfume microcapsules where proper mixing energy was achieved in the microcapsule mixing zone to fully disperse the microcapsules without fracturing them. As shown, aggregate sizes of less than about 100 microns were surprisingly achieved, in some instances less than about 50 microns, and in further instances even zero aggregates (i.e., microcapsules standing alone without aggregation) were achieved. The microcapsules in FIG. 4 avoid many of the above noted issues that can result when microcapsule aggregates become as shown in FIG. 3. Accordingly, sufficient energy input from the agitation device in the microcapsule mixing zone may range from about 100 J/kg to about 400 J/kg.

Similarly, without intending to be bound by theory, it is believed insufficient or no mixing of the opacifier in the opacifier mixing zone can lead to the opacifier aggregation, which can be seen as white particles that do not completely disperse. It may also pose a white particle settling problem in the liquid detergent product. In some examples, without being bound by theory, it is further believed that where a soil suspending polymer is added prior to the opacifier mixing zone, improper mixing in the opacifier mixing zone can lead to the formation of gel particles. The white particles and gel particles can aggregate together to form white gel balls that may end up in the liquid detergent product. In addition, the gel balls can also clog up pipes and mixers during processing. Accordingly, sufficient energy input from the agitation device in the opacifier mixing zone may range from about 50 J/kg to about 300 J/kg.

It is also believed that insufficient or no mixing of the structurant in the structurant mixing zone can lead to formation of gel particles. These gel particles may also aggregate with the white particles to form white gel balls that may be seen in the liquid detergent product, and can clog up pipes and mixers during processing. Accordingly, sufficient energy input from the agitation device in the structurant mixing zone may range from about 100 J/kg to about 400 J/kg.

During steady state, the mean residence time between addition of the detergent ingredients and the detergent ingredients entering the mixing regions may range from about 0.001 to 20 seconds. In some examples, the mean residence time between addition of the detergent ingredients and the detergent ingredients entering mixing regions may range from about 0.001 to 10 seconds. In other examples, when the process is not in steady state, the mean residence time between addition of the detergent ingredients and the detergent ingredients entering the mixing regions is less than about 60 seconds. Applicants have found that when the mean residence time is greater than 60 seconds, white particles, gel particles & gel balls, and microcapsule agglomeration can become an issue.

Unstructured Liquid Detergent Precursor

As shown in FIGS. 1 & 2, an unstructured liquid detergent precursor (105) is introduced into a vessel (100). The unstructured liquid detergent precursor may comprise from about 0% to about 15%, by weight of the precursor, of water. In some examples, the unstructured liquid detergent precursor may comprise from about 0% to about 7%, by weight of the precursor, of water.

The unstructured liquid detergent precursor may comprise from about 1% to 80%, by weight of the precursor, of a surfactant. In some examples, the unstructured liquid detergent precursor may comprise from about 5% to 65%, by weight of the precursor, of surfactant. In other examples, the unstructured liquid detergent may comprise from about 10% to 50%, by weight of the precursor, of surfactant.

Detersive surfactants utilized can be of the anionic, nonionic, zwitterionic, ampholytic or cationic type or can comprise compatible mixtures of these types. In some examples, surfactants are selected from the group consisting of anionic, nonionic, cationic surfactants and mixtures thereof. In other examples, surfactants are selected from the group consisting of anionic and nonionic surfactants, and mixtures thereof. In further examples, the detergent products are substantially free of betaine surfactants. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980.

Anionic Surfactants

In some examples, the detergent precursor (105, 205) may comprise from about 1% to about 90%, by weight of the precursor, of one or more anionic surfactants. In other examples, the detergent precursor (105, 205) may comprise up to about 55%, by weight of the precursor, of one or more anionic surfactants. In further examples, the detergent precursor (105, 205) may comprise from about 15% to about 60%, by weight of the precursor, of one or more anionic surfactants. In even further examples, the detergent precursor (105, 205) may comprise up to about 40%, by weight of the precursor, of one or more anionic surfactants. The liquid detergent product (125, 225) may comprise up to about 45%, by weight of the detergent product, of one or more anionic surfactants. In some examples, the liquid detergent product (125, 225) may comprise up to about 30%, by weight of the detergent product, of one or more anionic surfactants.

Specific, non-limiting examples of suitable anionic surfactants include any conventional anionic surfactant typically used in detergent products. This may include a sulfate detersive surfactant, for e.g., alkoxylated and/or non-alkoxylated alkyl sulfate materials, and/or sulfonic detersive surfactants, e.g., alkyl benzene sulfonates.

Alkoxylated alkyl sulfate materials comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. Included in the term "alkyl" is the alkyl portion of acyl groups. In some examples, the alkyl group contains from about 15 carbon atoms to about 30 carbon atoms. In other examples, the alkyl ether sulfate surfactant may be a mixture of alkyl ether sulfates, said mixture having an average (arithmetic mean) carbon chain length within the range of about 12 to 30 carbon atoms, and in some examples an average carbon chain length of about 25 carbon atoms, and an average (arithmetic mean) degree of ethoxylation of from about 1 mol to 4 mols of ethylene oxide, and in some examples an average (arithmetic mean) degree of ethoxylation of 1.8 mols of ethylene oxide. In further examples, the alkyl ether sulfate surfactant may have a carbon chain length between about 10 carbon atoms to about 18 carbon atoms, and a degree of ethoxylation of from about 1 to about mols of ethylene oxide.

Non-ethoxylated alkyl sulfates may also be added to the disclosed detergent precursor compositions and used as an anionic surfactant component. Examples of non-alkoxylated, e.g., non-ethoxylated, alkyl sulfate surfactants include those produced by the sulfation of higher $C_8$-$C_{20}$ fatty alcohols. In some examples, primary alkyl sulfate surfactants have the general formula: $ROSO_3$-M+, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium.

Other useful anionic surfactants can include the alkali metal salts of alkyl benzene sulfonates, in which the alkyl group contains from about 9 to about 15 carbon atoms, in straight chain (linear) or branched chain configuration, e.g. those of the type described in U.S. Pat. Nos. 2,220,099 and 2,477,383. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as $C_{11.8}$ LAS. Such surfactants and their preparation are described for example in U.S. Pat. Nos. 2,220,099 and 2,477,383.

Other anionic surfactants useful herein are the water-soluble salts of paraffin sulfonates and secondary alkane sulfonates containing from about 8 to about 24 (and in some examples about 12 to 18) carbon atoms; alkyl glyceryl ether sulfonates, especially those ethers of $C_8$-$C_{18}$ alcohols (e.g., those derived from tallow and coconut oil). Mixtures of the alkylbenzene sulfonates with the above-described paraffin sulfonates, secondary alkane sulfonates and alkyl glyceryl ether sulfonates may also be useful. Further suitable anionic surfactants useful herein may be found in U.S. Pat. No. 4,285,841, Barrat et al., issued Aug. 25, 1981, and in U.S. Pat. No.

3,919,678, Laughlin, et al., issued Dec. 30, 1975, both of which are herein incorporated by reference.

Nonionic Surfactants

In addition to the anionic surfactant component, the detergent precursor may further comprise a nonionic surfactant. In some examples, the detergent precursor (105, 205) may comprise from about 0.01% to about 30%, by weight of the precursor, of one or more nonionic surfactants. In further examples, the liquid detergent precursor (105, 205) may comprise from about 0.1% to about 20%, by weight of the precursor, of one or more nonionic surfactants. The liquid detergent product (125, 225) may comprise from about 0.01% to about 35%, by weight of the detergent product, of one or more nonionic surfactants. In some examples, the liquid detergent product (125, 225) may comprise from about 0.01% to about 25%, by weight of the detergent product, of one or more nonionic surfactants.

uitable nonionic surfactants useful herein can comprise any conventional nonionic surfactant typically used in liquid and/or solid detergent products. These can include, for e.g., alkoxylated fatty alcohols and amine oxide surfactants. Preferred for use in the liquid detergent products disclosed herein are those nonionic surfactants that are normally liquid.

In some examples, the detergent precursor may comprise from about 0.01% to about 5%, or from about 0.01% to about 4%, by weight of the surfactant, of an ethoxylated nonionic surfactant. These materials are described in U.S. Pat. No. 4,285,841, Barrat et al, issued Aug. 25, 1981. The nonionic surfactant may be selected from the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. In one example, the nonionic surfactant is selected from ethoxylated alcohols having an average of about 24 carbon atoms in the alcohol and an average degree of ethoxylation of about 9 moles of ethylene oxide per mole of alcohol.

Other non-limiting examples of nonionic surfactants useful herein include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1 to 30, as discussed in U.S. Pat. No. 6,153,577, U.S. Pat. No. 6,020,303 and U.S. Pat. No. 6,093,856; Alkylpolysaccharides as discussed in U.S. Pat. No. 4,565,647 to Llenado, issued Jan. 26, 1986; specifically alkylpolyglycosides as discussed in U.S. Pat. No. 4,483,780 and U.S. Pat. No. 4,483,779; Polyhydroxy fatty acid amides as discussed in U.S. Pat. No. 5,332,528, WO 92/06162, WO 93/19146, WO 93/19038, and WO 94/09099; and ether capped poly(oxyalkylated) alcohol surfactants as discussed in U.S. Pat. No. 6,482,994 and WO 01/42408.

Anionic/Nonionic Combinations

The detergent precursor may comprise combinations of anionic and nonionic surfactant materials. When this is the case, in some examples, the weight ratio of anionic surfactant to nonionic surfactant may be at least about 2:1. In other examples, the weight ratio of anionic surfactant to nonionic surfactant may be at least about 5:1. In further examples, the weight ratio of anionic surfactant to nonionic surfactant may be at least about 10:1.

Cationic Surfactant

The detergent precursor is, in some examples, substantially free of cationic surfactants and surfactants that become cationic below a pH of 7, alternatively below a pH of 6. In other examples, the detergent precursor may comprise cationic surfactants. The cationic surfactant may be present in amounts from about 0.01% to about 5%, or from about 0.01% to about 4%, by weight of the surfactant. Without being limited by theory, it is believed that cationic surfactants may be used herein to provide fabric softening and/or antistatic benefits.

Cationic surfactants are well known in the art and examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006, which is herein incorporated by reference; d) cationic ester surfactants as discussed in U.S. Pat. Nos. 4,228,042, 4,239,660 4,260,529 and U.S. Pat. No. 6,022,844, which is herein incorporated by reference; and e) amino surfactants as discussed in U.S. Pat. No. 6,221,825 and WO 00/47708, which is herein incorporated by reference, and specifically amido propyldimethyl amine (APA). Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Amphoteric Surfactants

Examples of amphoteric surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. Examples of compounds falling within this definition are sodium 3-(dodecylamino)propionate, sodium 3-(dodecylamino) propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. See U.S. Pat. No. 3,929,678 to Laughlin et al., issued Dec. 30, 1975 at column 19, lines 18-35, for examples of amphoteric surfactants.

Zwitterionic Surfactants

Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants; betaine, including alkyl dimethyl betaine and cocodimethyl amidopropyl betaine, $C_8$-$C_{18}$ (and in some examples $C_{12}$-$C_{18}$) amine oxides and sulfo and hydroxy betaines, such as N-alkyl-N,N-dimethylammino-1-propane sulfonate where the alkyl group can be $C_8$-$C_{18}$, and in some examples, $C_{10}$-$C_{14}$.

Other Detergent Precursor Ingredients

The detergent precursor described herein may also comprise additional ingredients. The precise nature of these additional components and levels of incorporation thereof will depend on the physical form of the composition, and the precise nature of the cleaning operation for which it is to be used.

The additional ingredients may be selected from the group consisting of builders, structurants or thickeners, clay soil removal/anti-redeposition agents, soil suspending polymers, polymeric dispersing agents, polymeric grease cleaning agents, enzymes, enzyme stabilizing systems, bleaching compounds, bleaching agents, bleach activators, bleach catalysts, brighteners, dyes, fabric hueing agents, dye transfer inhibiting agents, chelating agents, suds suppressors, fabric softeners, perfumes, soaps, solvents, antioxidant and pH modifiers.

This listing of such ingredients is exemplary only, and not by way of limitation of the types of ingredients which can be used with surfactants systems herein. A detailed description of additional components can be found in U.S. Pat. No. 6,020,303.

Perfume Microcapsules

As shown in FIG. 1, perfume microcapsules (110) may be incorporated into the unstructured detergent precursor (105). By "perfume microcapsule", it is meant, herein, a perfume that is encapsulated in a microcapsule. The perfume microcapsule comprises a core material, which enclose at least one perfume, and a wall material, the shell, that at least partially surrounds the core material.

The microcapsules shell may be characterized by its mean particle size, particle size distribution, and particle shell thickness. In some examples, the perfume microcapsule may have a mean particle size of from 1 micron to 80 microns, 5 microns to 60 microns, from 10 microns to 50 microns, or even from 15 microns to 25 microns. The particle size distribution can be narrow, broad or multimodal. A certain degree of particle aggregation may occur when the microcapsules are introduced into the detergent precursor as shown above in FIGS. 3 & 4. In some examples, the average microcapsule aggregate particle size will range from about 1 μm to about 100 μm, 5 μm to about 100 μm, or even about 15 μm to about 100 μm. In other examples, the average microcapsule aggregate particle size will range from about 10 μm to about 75 μm. In further examples, the average microcapsule aggregate particle size will be less than about 50 μm. As noted above, the average microcapsule aggregate size should be less than about 100 microns so that the aggregates do not become visible to the eye in the liquid detergent product; the microcapsules better and more evenly deposit on fabric; the liquid detergent product is more stable over extended periods of time, thereby avoiding issues with product separation, settling or creaming out; and the aggregated microcapsules do not clog pipes and mixers during processing.

The microcapsule shell may a desired thickness. In some examples, at least 75%, 85% or even 90% of said microcapsule have a shell thickness of from 60 nm to 250 nm, from 80 nm to 180 nm, or even from 100 nm to 160 nm.

The shell material may be a resin produced by the reaction product of an aldehyde and an amine. In some examples, aldehydes may include formaldehyde; and amines may include melamine, urea, benzoguanamine, glycoluril, and mixtures thereof. Exemplary melamines can include methylol melamine, methylated methylol melamine, imino melamine and mixtures thereof. Exemplary ureas can include dimethylol urea, methylated dimethylol urea, urea-resorcinol, and mixtures thereof. These materials may be obtained from one or more of the following companies Solutia Inc. (St Louis, Mo. U.S.A.), Cytec Industries (West Paterson, N.J. U.S.A.), Sigma-Aldrich (St. Louis, Mo. U.S.A.). In some examples, the shell of the microcapsule is made from the condensation of melamine and formaldehyde.

The core of the perfume microcapsule comprises one or more perfume materials. In some examples, the perfume microcapsule comprise, based on total particle weight, from 20% to 95%, from 50% to 90%, from 70% to 85%, or even from 80% to 85% by weight of a perfume material. Selection of the type or amount of perfume material is mainly based on aesthetic considerations.

Exemplary perfume materials for use herein include materials that provide an olfactory aesthetic benefit and/or help to cover any "chemical" odour that the product may have. Accordingly, by perfume or perfume material, it is meant any substance that has the desired olfactory property, which includes all fragrances or perfumes that are commonly used in perfumery or in laundry detergent or cleaning product compositions. Such perfume material may have a natural, semi-synthetic or synthetic origin. Perfume materials may be selected form the class of substance comprising the hydrocarbons, aldehydes or esters. Perfume materials may also include natural extracts and/or essences, which may comprise complex mixtures of constituents, such as orange oil, lemon oil, rose extract, lavender, musk, patchouli, balsam essence, sandalwood oil, pine oil, and cedar oil.

The core of the microcapsules may comprise only perfume material as the sole hydrophobic material or, alternatively, the core of the microcapsules may, in addition to the perfume material, include a further hydrophobic material in which the perfume material is dissolved or dispersed. The hydrophobic materials, which can be used as a core material in addition to the perfume material, include all types of oils, such as vegetable oils, animal oils, mineral oils, paraffins, chloroparaffins, fluorocarbons, and other synthetic oils.

Such material may be selected from the group consisting of vegetable oil, including neat and/or blended vegetable oils including castor oil, coconut oil, cottonseed oil, grape oil, rapeseed, soybean oil, corn oil, palm oil, linseed oil, safflower oil, olive oil, peanut oil, coconut oil, palm kernel oil, castor oil, lemon oil and mixtures thereof; esters of vegetable oils, esters, including dibutyl adipate, dibutyl phthalate, butyl benzyl adipate, benzyl octyl adipate, tricresyl phosphate, trioctyl phosphate and mixtures thereof; straight or branched chain hydrocarbons, including those straight or branched chain hydrocarbons having a boiling point of greater than 80° C.; partially hydrogenated terphenyls, dialkyl phthalates, alkyl biphenyls, including monoisopropylbiphenyl, alkylated naphthalene, including dipropylnaphthalene, petroleum spirits, including kerosene, mineral oil and mixtures thereof; aromatic solvents, including benzene, toluene and mixtures thereof; silicone oils; and mixtures thereof.

Other suitable perfume compounds and compositions can be found in the art including U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979.

The perfume microcapsules are present in an aqueous slurry. The microcapsule slurry may comprise less than about 75% water, alternatively less than 50% water, alternatively less than 42% water, by weight of the microcapsule slurry. The microcapsule slurry may have a viscosity of at least about 300 mPa·s at 25° C.

Opacifier

As shown in FIG. 2, an opacifier (210) may be incorporated into the unstructured detergent precursor (205). An opacifier is a solid, inert compound that does not dissolve in the composition and refracts, scatters or absorbs most light wavelengths.

The opacifier may be selected from the group consisting of styrene/acrylate latexes, titanium dioxide, Tin dioxide, any forms of modified $TiO_2$, for example carbon modified $TiO_2$ or metallic doped (e.g. Platinum, Rhodium) $TiO_2$ or stannic oxide, bismuth oxychloride or bismuth oxychloride coated $TiO_2$/Mica, silica coated $TiO_2$ or metal oxide coated and mixtures thereof. In some examples, styrene/acrylate latexes available from the Rohm & Haas Company and sold under the trademark Acusol are used. The latexes may be characterized by pH of about 2 to about 3, having approximately 40% solids in water, with a particle size of about 0.1 to about 0.5 micron. In other examples, Acusol® polymers may be used and include Acusol® OP301 (styrene/acrylate) polymer, Acusol® OP302, (Styrene/Acrylate/Divinylbenzene Copolymer), Acusol® OP303 (Styrene/Acrylamide Copolymer), Acusol® OP305 (Styrene/PEG-10 Maleate/Nonoxynol-10 Maleate/Acrylate Copolymer) and (Styrene/Acrylate/PEG-10 Dimaleate Copolymer) and mixtures thereof. The polymers may have a molecular weight of from 1,000 to 1,000,000, in some examples from 2,000 to 500,000, and in further examples from 5,000 to 20,000.

The opacifier may be present in an amount sufficient to leave the liquid detergent product, in which it is incorporated, white. Where the opacifier is an inorganic opacifier (e.g. $TiO_2$, or modifications thereof), the opacifier may be present at a level of from 0.001% to 1%, in some examples from 0.01% to 0.5%, and in further examples from 0.05% to 0.15% by weight of the liquid detergent product. Where the opacifier is an organic opacifier (e.g. styrene/acrylate latexes), the opacifier may be present at a level of from 0.001% to 2.5%, in some examples from 1% to 2.2%, and in further examples from 1.4% to 1.8% by weight of the liquid detergent product.

Enzymes

As shown in FIGS. 1 & 2, one or more detersive enzymes (130, 230) that provide cleaning performance and/or fabric care benefits may be incorporated in the unstructured detergent precursor (105, 205). Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and known amylases, or combinations thereof. In some examples, an enzyme combination comprising a cocktail of conventional detersive enzymes like protease, lipase, cutinase and/or cellulase in conjunction with amylase is used. Detersive enzymes are described in greater detail in U.S. Pat. No. 6,579,839.

If employed, enzymes will normally be incorporated into the liquid detergent products herein at levels sufficient to provide up to 3 mg by weight, in some examples from about 0.0001 mg to about 2.5 mg, of active enzyme per gram of the detergent product. Stated otherwise, the liquid detergent products herein can typically comprise from 0.001% to 5%, in some examples 0.005% to 3% by weight, of a commercial enzyme preparation. The activity of the commercial enzyme preparation is typically in the range of 10 to 50 mg active enzyme protein per gram of raw material.

Structurants

As shown in FIGS. 1 & 2, a structurant (120, 220) is incorporated in the unstructured detergent precursor (105, 205). Structured liquids can either be internally structured, whereby the structure is formed by primary ingredients (e.g. surfactant material) and/or externally structured by providing a three dimensional matrix structure using secondary ingredients (e.g. polymers, clay and/or silicate material). The liquid detergent product may comprise from about 0.01% to about 5%, by weight of the detergent product, of a structurant, and in some examples, from about 0.1% to about 2.0%, by weight of the detergent product, of a structurant. The structurant may be selected from the group consisting of diglycerides and triglycerides, ethylene glycol distearate, microcrystalline cellulose, cellulose-based materials, microfiber cellulose, biopolymers, xanthan gum, gellan gum, and mixtures thereof. In some examples, a suitable structurant includes hydrogenated castor oil, and non-ethoxylated derivatives thereof. Other suitable structurants are disclosed in U.S. Pat. No. 6,855,680. Such structurants have a thread-like structuring system having a range of aspect ratios. Further suitable structurants and the processes for making them are described in WO 2010/034736.

Adjunct Ingredients

As shown in FIGS. 1 & 2, one or more adjunct ingredients may be added to the detergent precursor (105, 205) at injection points 140, 145, 240, and/or 245. The one or more adjuncts may be selected from the group consisting of: soil suspending polymers, antioxidants, rheology modifiers, fabric care benefit agents, deposition aids, builders, bleaching systems, optical brighteners, pearlescent agents, perfumes, enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents and mixtures thereof.

Soil Suspending Polymers

The cleaning compositions described herein may also optionally contain water-soluble ethoxylated amines having soil suspending and anti-redeposition properties. The composition may contain about 0.01% to about 8% by weight of the composition, of a soil suspending polymer.

An example of a soil suspending polymer is ethoxylated tetraethylenepentamine. Ethoxylated amines are further described in U.S. Pat. No. 4,597,898, issued Jul. 1, 1986. Other soil suspending polymers may include the cationic compounds disclosed in European Patent Application 111,965, published Jun. 27, 1984, ethoxylated amine polymers as disclosed in European Patent Application 111,984, published Jun. 27, 1984; zwitterionic polymers as disclosed in European Patent Application 112,592, published Jul. 4, 1984; and amine oxides as disclosed in U.S. Pat. No. 4,548,744, issued Oct. 22, 1985. Other examples of a soil suspending polymer may include carboxymethyl cellulose (CMC) materials or hydroxypropyl methyl celluloses (HPMC). Of course, other suitable soil suspending polymers that may be utilized in the detergent compositions will be apparent to those of ordinary skill in the art in view of the teachings herein.

Antioxidant

The liquid detergent precursor may contain an antioxidant. Also, antioxidant may be added at injection points 140, 145, 240, and/or 245 to the detergent precursor. In some examples, antioxidant may only be present in the precursor. In other examples, antioxidant may only be added to the precursor, which is free of antioxidant, via injection points 140, 145, 240, and/or 245. In preferred examples, antioxidant may be both present in the detergent precursor and subsequently added to the precursor at injection points 140, 145, 240, and/or 245. Although not wishing to be bound by theory, the Applicants believe that the presence of antioxidant reduced or preferably stops the reaction of reactive compounds in the formula e.g. perfumes, which tend to be oxidized over time and higher temperature and which can lead to yellowing.

An antioxidant is a molecule capable of slowing or preventing the oxidation of other molecules. Oxidation reactions can produce free radicals, which in turn can start chain reactions of degradation. Antioxidants terminate these chain reactions by removing the free radical intermediates and inhibiting other oxidation reactions by being oxidized themselves. As a result, antioxidants are often reducing agents. The antioxidant may be selected from the group consisting of butylated hydroxyl toluene (BHT), butylated hydroxyl anisole (BHA), trimethoxy benzoic acid (TMBA), α, β, λ and δ tocophenol (vitamin E acetate), 6 hydroxy-2,5,7,8-tetra-methylchroman-2-carboxylic acid (trolox), 1,2, benzisothiazoline-3-one (proxel GLX), tannic acid, galic acid, Tinoguard AO-6, Tinoguard TS, ascorbic acid, alkylated phenol, ethoxyquine 2,2,4 trimethyl, 1-2-dihydroquinoline, 2,6 di or tert or butyl hydroquinone, tert, butyl, hydroxyl anisole, lignosulphonic acid and salts thereof, benzofuran, benzopyran, tocopherol sorbate, butylated hydroxyl benzoic acid and salts thereof, galic acid and its alkyl esters, uric acid, salts thereof and alkyl esters, sorbic acid and salts thereof, dihydroxy fumaric acid and salts thereof, and mixtures thereof. In some examples, antioxidants are those selected from the group consisting of alkali and alkali earth metal sulfites and hydrosulfites, and in further examples, antioxidants are selected from sodium sulfite, potassium bi-sulfite or hydrosulfite.

The antioxidant may be present at a level of from 0.01% to 2%, in some examples from 0.1% to 1%, and in further examples from 0.3% to 0.5% by weight of the liquid detergent product.

Fabric Care Benefit Agents

The liquid detergent products may comprise a fabric care benefit agent. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, silicones, polyolefin waxes, latexes, oily sugar derivatives, cationic polysaccharides, polyurethanes, fatty acids and mixtures thereof. Fabric care benefit agents when present in the liquid detergent product are suitably at levels of up to 30% by weight of the liquid detergent product, in some examples from 1% to 20%, and in further examples from 2% to 10%.

Deposition Aid

As used herein, "deposition aid" refers to any cationic polymer or combination of cationic polymers that significantly enhance the deposition of a fabric care benefit agent onto the fabric during laundering. In some examples, the deposition aid is a cationic or amphoteric polymer. The amphoteric polymers may also have a net cationic charge, i.e., the total cationic charges on these polymers will exceed the total anionic charge. Nonlimiting examples of deposition enhancing agents are cationic polysaccharides, chitosan and its derivatives and cationic synthetic polymers. Cationic polysaccharides may include cationic cellulose derivatives, cationic guar gum derivatives, chitosan and derivatives, and cationic starches.

Builder

The liquid detergent precursor may optionally comprise a builder. Suitable builders include polycarboxylate builders include cyclic compounds, particularly alicyclic compounds, such as those described in U.S. Pat. Nos. 3,923,679; 3,835,163; 4,158,635; 4,120,874 and 4,102,903. In some examples, citrate builders, e.g., citric acid and soluble salts thereof (particularly sodium salt). In other examples, builders may include ethylene diamine disuccinic acid and salts thereof (ethylene diamine disuccinates, EDDS), ethylene diamine tetraacetic acid and salts thereof (ethylene diamine tetraacetates, EDTA), and diethylene triamine penta acetic acid and salts thereof (diethylene triamine penta acetates, DTPA), aluminosilicates such as zeolite A, B or MAP.

Bleaching System

Bleaching agents suitable herein may include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from 1% to 40% by weight, in some examples from 2% to 30% by weight and in further examples from 5% to 25% by weight of liquid detergent product. Peroxyacid bleach precursors for use herein can include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors may be incorporated at levels in the range from 0.5% to 25%, and in some examples from 1% to 10% by weight of liquid detergent product while the preformed organic peroxyacids themselves are typically incorporated at levels in the range from 0.5% to 25% by weight, and in some examples from 1% to 10% by weight of liquid detergent product. Bleach catalysts that may be used herein include the manganese triazacyclononane and related complexes (U.S. Pat. No. 4,246,612, US-A-5227084); Co, Cu, Mn and Fe bispyridylamine and related complexes (U.S. Pat. No. 5,114,611); and pentamine acetate cobalt(III) and related complexes (U.S. Pat. No. 4,810,410).

Optical Brighteners

The liquid detergent precursor may contain an optical brightener. In addition, optical brighteners may be added at injection points 140, 145, 240, and/or 245 to the detergent precursor. In some examples, optical brightener may only be present in the precursor. In other examples, optical brightener may only be added to the precursor, which is free of optical brightener, via injection points 140, 145, 240, and/or 245. In preferred examples, optical brightener may be both present in the detergent precursor and subsequently added to the precursor at injection points 140, 145, 240, and/or 245. Such dyes have been found to exhibit good tinting efficiency during a laundry wash cycle without exhibiting excessive undesirable build up during laundering. The optical brightener may be included in the total laundry detergent product in an amount sufficient to provide a tinting effect to fabric washed in a solution containing the detergent. In one example, the liquid detergent product comprises, by weight of the liquid detergent product, from 0.0001% to 1%, in some examples from 0.0001% to 0.5% by weight of the liquid detergent product, and in further examples from 0.0001% to 0.3% by weight of the liquid detergent product, of an optical brightener.

Suitable optical brighteners, which may be used herein, can be classified into subgroups, which include, but are not necessarily limited to, derivatives of stilbene, pyrazoline, coumarin, carboxylic acid, methinecyanines, dibenzothiphene-5, 5-dioxide, azoles, 5- and 6-membered-ring heterocycles, and other miscellaneous agents. Examples of such brighteners are disclosed in "The Production and Application of Fluorescent Brightening Agents," M. Zahradnik, John Wiley & Sons, New York (1982). Specific non-limiting examples of optical brighteners which are useful in the present detergent products are those identified in U.S. Pat. No. 4,790,856 and U.S. Pat. No. 3,646,015.

Pearlescent Agent

The liquid detergent product may comprise a pearlescent agent. The pearlescent agent may be organic or inorganic, but is preferably inorganic. In some examples, the pearlescent agent is selected from mica, TiO2 coated mica, bismuth oxychloride or mixtures thereof.

Perfume

Perfumes may be incorporated into the liquid detergent product in addition to perfume microcapsules. The perfumes may be prepared as a premix liquid, may be linked with a carrier material, such as cyclodextrin.

Other Adjuncts

Examples of other suitable cleaning adjunct materials include, but are not limited to; enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents and mixtures thereof.

Liquid Detergent Product

The liquid detergent product (125, 225) resulting from the processes disclosed herein may comprise a final water content of from about 5% to about 15% by weight of the product. In some examples, the final water content may be from about 5% to about 10%.

Pouch/Pouch Material

The liquid detergent products disclosed may be incorporated into a water-soluble pouch. In some examples, the liquid detergent products may be incorporated into a multi-compartment water-soluble pouch.

The pouches may be made of a film material that is soluble or dispersible in water, and has a water-solubility of at least 50%, in some examples of at least 75% or in further examples even at least 95%. The water-solubility is measured by the method set out here after using a glass-filter with a maximum pore size of 20 microns: 50 grams±0.1 gram of pouch material is added in a pre-weighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Suitable pouch materials may include, but are not limited to, polymeric materials. In some examples, the polymers are formed into a film or sheet. The pouch material can, for example, be obtained by casting, blow-moulding, extrusion or blown extrusion of the polymeric material, as known in the art.

Other polymers, copolymers or derivatives thereof suitable for use as pouch material may be selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. In some examples, polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. The level of polymer in the pouch material, for example a PVA polymer, may be at least 60%. The polymer can have any weight average molecular weight of from 1000 to 1,000,000, in some examples from 10,000 to 300,000, and in further examples from 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of 10,000-40,000, in some examples a weight average molecular weight of about 20,000, and of PVA or copolymer thereof, with a weight average molecular weight of 100,000 to 300,000, in some examples a weight average molecular weight of about 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising 1-35% by weight polylactide and 65% to 99% by weight polyvinyl alcohol. In some examples, polymers for use herein are from 60% to 98% hydrolysed, and in further examples from 80% to 90% hydrolysed, to improve the dissolution characteristics of the material.

It will be obvious according to one skilled in the art in view of the teachings herein that different film materials and/or films of different thickness may be employed in making the compartments of the present invention. A benefit in selecting different films is that the resulting compartments may exhibit different solubility or release characteristics.

The pouch material herein can comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

For reasons of deformability pouches or pouch compartments containing a component which is liquid will preferably contain an air bubble having a volume of up to 50%, alternatively up to 40%, alternatively up to 30%, alternatively up to 20%, alternatively up to 10% of the volume space of said compartment.

Process for Making the Water-Soluble Pouch

The process for making the water-soluble pouch may be made using any suitable equipment and method. Single compartment pouches may be made using vertical or horizontal form filling techniques commonly known in the art.

The process for making a water-soluble pouch has been described in EP1504994 (Procter & Gamble Company) and WO 02/40351 (Procter & Gamble Company). The process for making a multi-compartment water-soluble pouch has been described in co-pending patent application 09161692.0 filed June 2009 (Procter & Gamble Company).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cite in the Detailed Description, in relevant part, incorporated herein by reference, the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for producing a liquid detergent product using a vessel comprising an inlet, an outlet, an agitation device, and a microcapsule mixing zone disposed between the inlet and the outlet, where the agitation device is in the microcapsule mixing zone, the method comprising:

a) introducing an unstructured liquid detergent precursor into the inlet of the vessel, said unstructured liquid detergent precursor comprising from about 10% to 90%, by weight of the precursor, of a surfactant, and water, which is present in an amount of up to about 15% by weight of the precursor;

b) mixing with the agitation device an aqueous slurry comprising perfume microcapsules and the unstructured liquid detergent precursor in the microcapsule mixing zone to form a combined microcapsule detergent, wherein the aqueous slurry has a viscosity of at least about 300 mPas at 25° C., and wherein the agitation device is a static mixer;

c) adding a structurant comprising hydrogenated castor oil to the combined microcapsule detergent downstream of the microcapsule mixing zone to form a liquid detergent product; and wherein the liquid detergent product has an average microcapsule aggregate particle size of less than 75 μm.

2. The method of claim 1 wherein the aqueous slurry is delivered to the unstructured liquid detergent precursor at a vessel location upstream of the microcapsule mixing zone.

3. The method of claim 1 wherein the structurant is added to the combined microcapsule detergent upstream of a structurant mixing zone.

4. The method of claim 3, wherein the structurant and the combined microcapsule detergent are mixed in the structurant mixing zone.

5. The method of claim 1, wherein the method further comprises prior to step b) adding an enzyme to the unstructured liquid detergent precursor upstream of the microcapsule mixing zone.

6. The method of claim 5 wherein the enzyme and unstructured liquid detergent precursor are mixed in an enzyme mixing zone disposed upstream of the microcapsule mixing zone.

7. The method of claim 1, wherein the static mixer delivers an energy input of from about 50 J/kg to about 500 J/kg.

8. The method of claim 1, wherein the microcapsules have a mean particle size of from about 15 μm to about 25 μm.

9. The method of claim 1, wherein the liquid detergent product has an average microcapsule aggregate particle size of less than about 50 μm.

10. The method of claim 1, wherein the method further comprises adding one or more adjuncts just upstream of the microcapsule mixing zone, wherein the one or more adjuncts are selected from the group consisting of: soil suspending polymers, antioxidants, rheology modifiers, fabric care benefit agents, deposition aids, builders, bleaching systems, optical brighteners, pearlescent agents, perfumes, enzymes, enzyme stabilizing systems; scavenging agents, complexing agents for anionic surfactants; fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents; and mixtures thereof.

11. The method of claim 1, wherein the unstructured liquid detergent precursor further comprises builders, structurants or thickeners, clay soil removal/anti-redeposition agents, soil suspending polymers, polymeric dispersing agents, polymeric grease cleaning agents, enzymes, enzyme stabilizing systems, bleaching compounds, bleaching agents, bleach activators, bleach catalysts, brighteners, dyes, fabric hueing agents, dye transfer inhibiting agents, chelating agents, suds suppressors, fabric softeners, perfumes, and mixtures thereof.

12. The method of claim 1, wherein the structurant further comprises diglycerides, triglycerides other than hydrogenated castor oil, ethylene glycol distearate, microcrystalline cellulose, cellulose-based materials, microfiber cellulose, biopolymers, xanthan gum, gellan gum, or mixtures thereof.

13. The method of claim 1, wherein an opacifier is incorporated into the unstructured detergent precursor, wherein the opacifier is selected from the group consisting of: styrene/acrylate latexes, titanium dioxide, tin dioxide, modified $TiO_2$, stannic oxide, bismuth oxychloride or bismuth oxychloride coated $TiO_2$/Mica, silica or metal coated $TiO_2$, and mixtures thereof.

* * * * *